United States Patent [19]

Uda et al.

[11] 4,142,504

[45] Mar. 6, 1979

[54] LUBRICATING OIL PUMP FOR TWO CYCLE INTERNAL COMBUSTION ENGINES

[75] Inventors: Ryoji Uda; Tomoya Kimura, both of Kakogawa, Japan

[73] Assignee: Kawasaki Jukogyo Kabushiki Kaisha, Kobe, Japan

[21] Appl. No.: 760,325

[22] Filed: Jan. 18, 1977

[51] Int. Cl.[2] ..... F02B 517/08

[52] U.S. Cl. ..... 123/198 D; 123/196 S; 184/6.4

[58] Field of Search ..... 123/73 AD, 196 S, 198 D; 184/6.4, 27, 32, 35

[56] References Cited

U.S. PATENT DOCUMENTS 3,648,677 3/1972 Straubel ..... 123/196 S

*Primary Examiner*—Ronald H. Lazarus

*Attorney, Agent, or Firm*—Fleit & Jacobson

[57] ABSTRACT

Variable displacement type lubricating oil pump for two cycle engines having a displacement control element which is rotated in response to the engine throttle valve position. The control element has a cam which is so shaped that the pump displacement is changed in accordance with the engine throttle valve position. When the control element is accidentally disconnected from the engine throttle valve control device, the control element can be rotated beyond the minimum displacement position which corresponds to the engine idling position, whereby the pump displacement is increased than in the idling position.

8 Claims, 5 Drawing Figures

LUBRICATING OIL PUMP FOR TWO CYCLE INTERNAL COMBUSTION ENGINES

The present invention relates to lubricating oil supply device for internal combustion engines and more particularly to lubricating oil supply device for crank chamber precompression type two cycle internal combustion engines.

Conventional two cycle engines of the aforementioned type can be classified into two in respect of lubricating oil supply systems, one being a type which uses so-called mixed gasoline in which gasoline is added with lubricating oil and the other being a type which has an oil pump for providing a supply of lubricant. The engine which uses the mixed gasoline is preferable in respect of engine structure because it does not require any additional device for providing a supply of lubricating oil. However, since it is impossible in this type of engine to control the amount of supply of lubricating oil as desired in accordance with load and speed of the engine, most of recent two cycle engines are equipped with lubricating oil pumps.

In general, such oil pumps are of variable displacement type and the displacement is controlled in accordance with the throttle valve position of the engine. More specifically, in case of motorcycles, the throttle actuating cable is connected to the displacement control mechanism of the pump so that the supply of lubricating oil is increased in accordance with an increase in the throttle valve opening.

The pump displacement control mechanism has an idle stop by which the smallest displacement of the pump is determined. When the engine throttle valve is placed in closed or idling position, the displacement control mechanism is engaged with the stop so that the pump supplies the minimum amount of lubricating oil.

In the conventional arrangement, disadvantage will be encountered in that the pump displacement control mechanism is returned to the minimum position when the throttle actuating cable is accidentally released from the displacement control mechanism due, for example, to breakage of the cable leading to the mechanism, resulting in a minimized oil supply even under a loaded and high speed operation of the engine. Thus, the lubrication may possibly become inadequate and engine seize may be produced.

The present invention has therefore an object to provide a lubricating oil supply device in which the aforementioned problems of prior art can be overcome.

Another object of the present invention is to provide a lubricating oil supply device in which the displacement control mechanism is automaticaly shifted, when the control cable is accidentally disconnected from the control mechanism, to a position where the pump displacement is greater than that in idle position.

The above and other objects can be accomplished in accordance with the present invention by a lubricating oil supply device for two cycle internal combustion engines, said device comprising variable displacement type oil pump means, means for controlling the displacement of the oil pump means, said control means including a control element movable from a maximum displacement position through a minimum displacement position to a third position where the displacement of the pump is greater than that in the minimum displacement position, means for biasing the control element toward the third position, stop means for limiting the control element to move under influence of the biasing means beyond the third position, and means for moving said control element against said biasing means in accordance with operating condition of the engine. Preferably, the control element has a cam which is so shaped that appropriate change in pump displacement is provided.

The above and other objects and features of the present invention will become apparent from the following descriptions of a preferred embodiment taking reference to the accompanying drawings, in which.

Figure 1:
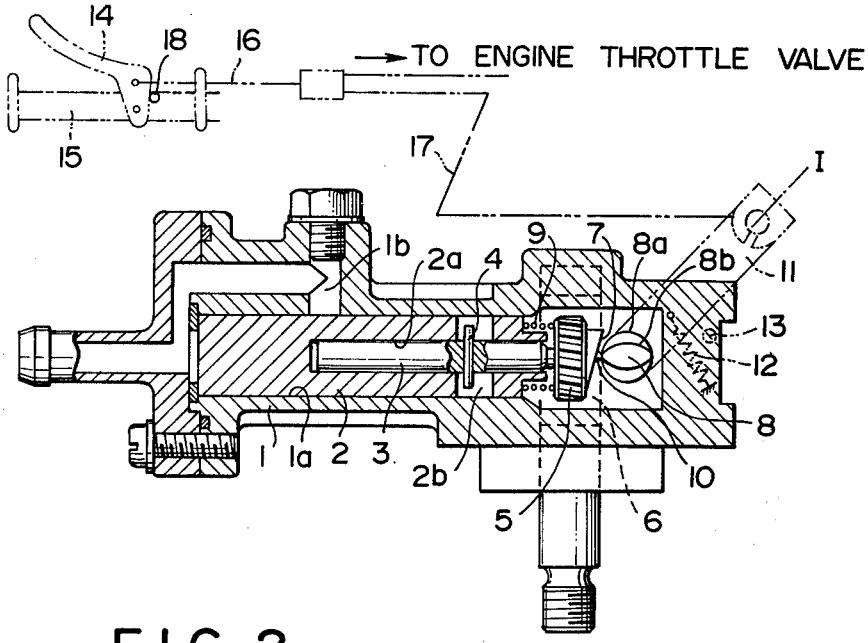
FIG. 1 is a sectional view of a lubricating oil supply pump embodying the feature of the present invention.
Figure 2:
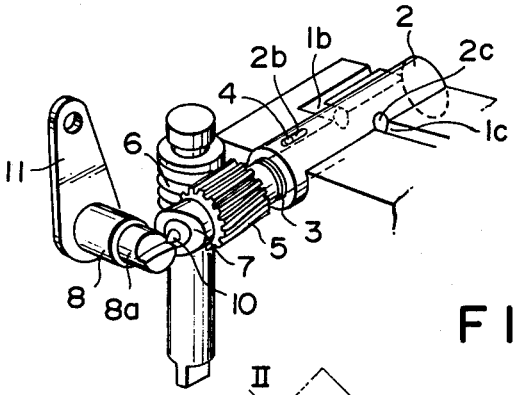
FIG. 2 is a perspective view of the displacement control mechanism employed in the oil pump shown in FIG. 1.

Referring now to the drawings, particularly to FIGS. 1 and 2, the lubricating oil pump shown therein includes a pump housing 1 having a cylindrical bore 1*a*, and a sleeve 2 rotatably received in the cylindrical bore 1*a*. The sleeve 2 is also formed with a cylindrical axial bore 2*a* which receives a pump plunger 3. The sleeve 2 has a pair of diametrically opposed axially extending slots 2*b* and a diametrically extending pin 4 provided on the plunger 3 engages the slots 2*b*. Thus, the plunger 3 is axially movable in the bore 2*a* with respect to the sleeve 2 but it rotates in the bore 1*a* together with the sleeve 2.

The pump housing 1 is formed with an oil inlet 1*b* and an oil discharge or outlet 1*c* which can be seen in FIG. 2. The pump sleeve 2 is also formed with a port 2*c* which communicates at one end with the axial bore 2*a* in the sleeve 2 and opens at the other end to the outer surface of the sleeve 2. Thus, as the sleeve 2 rotates, the bore 2*a* cyclically communicates with the inlet 1*b* and the outlet 1*c* in the housing 1.

The plunger 3 is provided at the outer end portion with a worm wheel 5 which is in meshing engagement with a worm 6 driven by an engine with which the pump is associated. The plunger 3 is further formed with a cam 7 at the outer end and a control element 8 is rotatably mounted on the housing 1 for co-operation with the cam 7. The control element 8 has a cylindrical outer surface 8*a* against which the cam 7 on the plunger 3 is forced into engagement under the influence of a spring 9 which acts between the pump sleeve 2 and the worm wheel 5 on the plunger 3.

Thus, it will be understood that, as the plunger 3 is rotated by the worm 6 through the worm wheel 5, the rotation is transmitted to the sleeve 2 so that the port 2*c* is cyclically brought into communication with the inlet port 1*b* and the outlet port 1*c*. Simultaneously, the plunger 3 is reciprocated in the sleeve bore 2*a* due to the engagement of the cam 7 with the cylindrical surface 8*a* of the control element so that lubricating oil is introduced through the inlet 1*b* into the bore 2*a* and discharged through the outlet 1*c*.

As shown in FIGS. 1 and 2, the pump plunger 3 is further formed with a projection 10 and the control element 8 is formed with a cam 8*b* for cooperation with the projection 10. The engagement between the projection 10 and the cam 8*b* on the control element 8 limits the stroke of the plunger 3 so that the amount of discharge can be determined by the position of the cam 8*b*.

In order for applying a rotating movement to the control element 8, an actuating lever 11 is secured to the element. As shown in FIG. 1, the lever 11 is biased by a spring 12 clockwise toward a stop 13 which is provided on the housing 1.

In FIG. 1, there is shown a throttle valve actuating lever 14 which is provided on a grip 15 of a motorcycle. The lever 14 has a cable 16 which is employed for actuating engine throttle valve (not shown). The lever 11 for actuating the control element 8 is interconnected through a cable 17 to the throttle lever actuating cable 16. Thus, the position of the cam 8*b* is determined in accordance with the position of the engine throttle lever.

In the illustrated embodiment, a stop 18 is provided on the grip 15 for engagement with the lever 14 so as to determine the minimum or smallest throttle valve opening. In the position where the lever 14 engages the stop 18, the cam actuating lever 11 is apart from the stop 13 and the cam 8*b* is so located that it can engage with the projection 10 on the plunger 3 at the highest portion thereof. Thus, the pump displacement becomes the smallest in this position as shown by a in FIG. 5. This position is shown by I in FIGS. 3, 4 and 5.

As the throttle actuating lever 14 is moved to open the engine throttle valve, the lever 11 is moved counterclockwise to rotate the control element 8 with the cam 8*b* accordingly. Thus, a lower portion of the cam 8*b* is brought into a position for engagement with the projection 10. Therefore, the pump displacement and thus the pump output is increased as shown by b in FIG. 5.

Figure 3:
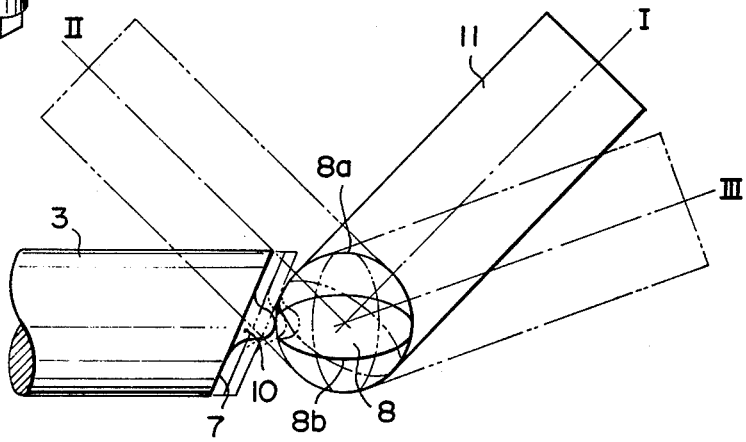
FIG. 3 is a diagrammatical view of the cam device employed in the displacement control mechanism.
Figure 4:
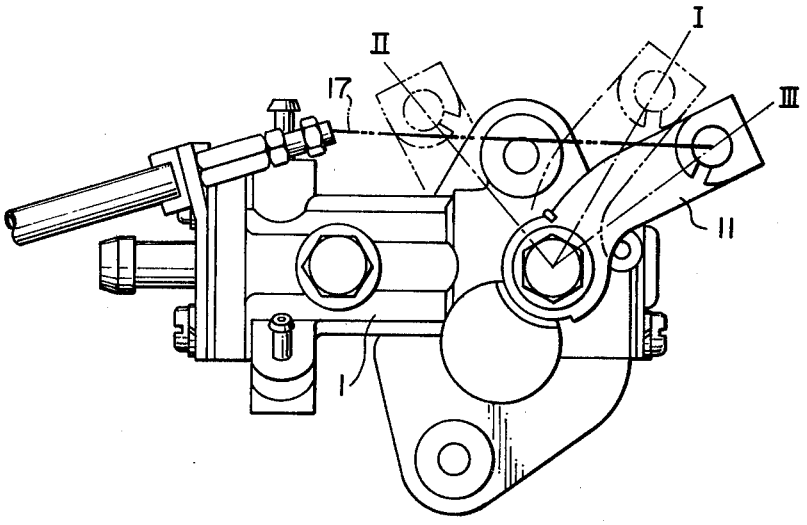
FIG. 4 is a side elevational view of the oil pump shown in FIG. 1.
Figure 5:
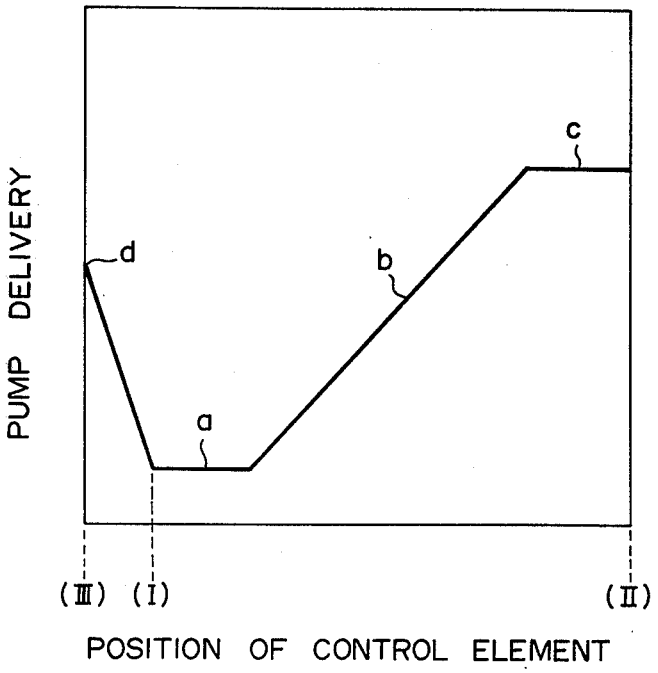
FIG. 5 is a diagram showing the oil delivery as obtained by the pump system in accordance with the present invention.

At the wide open throttle valve position, the cam actuating lever 11 assumes a position shown by II in FIGS. 3, 4 and 5 so as to provide the highest pump output as shown by c in FIG. 5.

The cam 8*b* is so shaped that, when the lever 11 is in the position shown by III in FIGS. 3, 4 and 5, where the lever 11 engages the stop 13, the pump displacement is increased as compared with that when the lever 11 is in the position I as shown by d in FIG. 5. Therefore, when the lever 11 is accidentally disconnected from the throttle actuating cable 16 due, for example, to breakage of the cable 17, the lever 11 is moved under the influence of the spring 12 to the position III whereby an increased amount of lubricating oil supply is maintained. In this manner, any possibility of inadequate lubrication can be avoided even under a failure of pump displacement control.

The invention has thus been shown and described with reference to a specific embodiment, however, it should be noted that the invention is in no way limited to the details of the illustrated structures but changes and modifications may be made without departing from the scope of the appended claims.

We claim:

1. Lubricating oil supply means for a two cycle internal combustion engine, said supply means comprising variable displacement type oil pump means for pumping oil, control means for controlling the displacement of the oil pump means, said control means including a control element movable from a maximim displacement position through a minimum displacement position to a third position where the displacement of the pump means is greater than that in the minimum displacement position, means for biasing the control element toward the third position, stop means for limiting the control element to move under influence of the biasing means beyond the third position, and means adapted to be responsive to an operating condition of the engine for moving said control element against said biasing means so that the control element is in the minimum displacement position under an idling operating condition of the engine and the displacement of the oil pump means is increased in accordance with an increase in engine output.

2. Lubricating oil supply means in accordance with claim 1 wherein the internal combustion engine includes an engine throttle valve and means for actuating the engine throttle valve, and wherein said means for moving said control element is motion transmitting means adapted for connecting said control element with the means for actuating the engine throttle valve.

3. Lubricating oil supply means in accordance with claim 2 in which said motion transmitting means is a cable adapted to be connected with the means for actuating the engine throttle valve.

4. Lubricating oil supply means in accordance with claim 1 in which said control element has a cam for co-operation with a cam-follower which is provided in the oil pump means for determining the displacement of the oil pump means.

5. Lubricating oil supply means for a two cycle internal combustion engine having a throttle valve controlled by a throttle actuating cable, said supply means comprising variable displacement type oil pump means for pumping oil, control means for controlling the displacement of the oil pump means, said control means including a control element movable from a maximum displacement position through a minimum displacement position to a third position where the displacement of the pump means is greater than that in the minimum displacement position, means for biasing the control element toward the third position, stop means for limiting the control element to move under influence of the biasing means beyond the third position, and means for moving said control element against said biasing means in accordance with operating condition of the engine, said means for moving being connected to and movable by the throttle actuating cable so that the control element is in the minimum displacement position under an idling operating condition of the engine and the displacement of the oil pump means is increased in accordance with an increase in engine output.

6. Lubricating oil supply means in accordance with claim 5 further comprising a throttle valve actuating lever for controlling movement of the throttle actuating cable and a stop engageable by the throttle valve actuating lever during an idling operating condition of the engine, the position of the stop determining the minimum displacement position of the pump means.

7. Lubricating oil supply means in accordance with claim 5 wherein the displacement of the pump means in the third position is less than the maximum displacement.

8. Lubricating oil supply means in accordance with claim 1 wherein the displacement of the pump means in the third position is less than the maximum displacement.

* * * * *